US010435896B2

(12) United States Patent
Wang et al.

(10) Patent No.: US 10,435,896 B2
(45) Date of Patent: Oct. 8, 2019

(54) APPARATUS AND METHOD FOR LIFTING AND SLIDING A STRUCTURE ATTACHED TO THE WALL

(71) Applicants: Guangzhou Construction Engineering Co., Ltd., Guangzhou (CN); Shanghai YeSheng Mechanical & Electrical Control Technology Co., LTD, Shanghai (CN)

(72) Inventors: Long Wang, Guangzhou (CN); Jianming Wen, Shanghai (CN); Junyue Gao, Guangzhou (CN); Wei Wei, Shanghai (CN); Yuantao Zhao, Shanghai (CN); Quan Shao, Guangzhou (CN); Yanfeng Jia, Shanghai (CN)

(73) Assignees: Guangzhou Construction Engineering Co., Ltd., Guangzhou (CN); Shanghai YeSheng Mechanical & Electrical Control Technology Co., LTD, Shanghai (CN)

( * ) Notice: Subject to any disclaimer, the term of this patent is extended or adjusted under 35 U.S.C. 154(b) by 410 days.

(21) Appl. No.: 15/373,956

(22) Filed: Dec. 9, 2016

(65) Prior Publication Data

US 2017/0089082 A1 Mar. 30, 2017

Related U.S. Application Data

(62) Division of application No. 14/162,206, filed on Jan. 23, 2014, now Pat. No. 9,670,684.

(30) Foreign Application Priority Data

Oct. 23, 2013 (CN) ..... 2013 1 0503992

(51) Int. Cl.
*B66C 23/20* (2006.01)
*B66C 23/26* (2006.01)
(Continued)

(52) U.S. Cl.
CPC ..... *E04G 21/167* (2013.01); *B66C 23/205* (2013.01); *E04G 21/00* (2013.01); *E04B 2/88* (2013.01); *Y10T 29/49904* (2015.01)

(58) Field of Classification Search
CPC ..... E04G 21/167; E04G 21/00; E04G 21/14; E04G 21/16; E04G 21/162; E04G 21/163;
(Continued)

(56) References Cited

U.S. PATENT DOCUMENTS 5,625,262 A * 4/1997 Lapota ..... H02P 5/52 318/432
7,546,929 B2 * 6/2009 Wierzba ..... B66C 11/04 212/326
(Continued)

FOREIGN PATENT DOCUMENTS

CN 103255917 8/2013
CN 103266779 8/2013

*Primary Examiner* — Bayan Salone
(74) *Attorney, Agent, or Firm* — Muncy, Geissler, Olds & Lowe, P.C.

(57) ABSTRACT

An apparatus for lifting and sliding a structure to be attached to a wall of a building, including a lifting platform extending outwardly from the building, and a synchronous lifting and sliding system which is arranged on the lifting platform. The lifting platform has two platform beams extending outwardly from the building, and a lifting beam placed on the platform beams. The synchronous lifting and sliding system has a hydraulic lifter arranged on the lifting beam, a hydraulic jack connected to the lifting beam, and a controller. A connecting rod is connected to one end of the hydraulic jack, and several installing holes are arranged at regular intervals on the connecting rod. The distance between the adjacent
(Continued)

installing holes of the connecting rod matches a stroke of the hydraulic jack. An installing ear-plate is provided on the platform beam to connect with the connecting rod.

1 Claim, 6 Drawing Sheets

(51) Int. Cl.

| | |
|---|---|
| ***E04G 21/16*** | (2006.01) |
| ***E04G 21/14*** | (2006.01) |
| ***E04G 21/00*** | (2006.01) |
| ***E04B 1/34*** | (2006.01) |
| ***E04B 1/35*** | (2006.01) |
| ***E04B 2/88*** | (2006.01) |

(58) Field of Classification Search

CPC . E04B 2/88; E04B 1/34; E04B 1/3404; E04B 1/35; E04B 1/3511; B66C 23/00; B66C 23/18; B66C 23/20; B66C 23/202; B66C 23/208; B66C 23/26; Y10T 29/49904

USPC ..... 29/402.01, 402.03, 402.08; 414/539, 414/546, 555, 540; 254/93 R, 124

See application file for complete search history.

(56) References Cited

U.S. PATENT DOCUMENTS

| | | | | |
|---|---|---|---|---|
| 9,278,831 | B2 * | 3/2016 | Gao | B66C 13/08 |
| 9,441,383 | B2 * | 9/2016 | Wang | B66C 17/06 |
| 9,670,684 | B2 * | 6/2017 | Wang | E04G 21/167 |
| 2011/0285157 | A1 * | 11/2011 | Bohler | B66C 1/34 294/82.11 |

* cited by examiner

APPARATUS AND METHOD FOR LIFTING AND SLIDING A STRUCTURE ATTACHED TO THE WALL

CROSS REFERENCE TO RELATED APPLICATIONS

This application is a Divisional of co-pending application Ser. No. 14/162,206, filed on Jan. 23, 2014, for which priority is claimed under 35 U.S.C. § 120; and this application claims priority of Application No. 201310503992.5 filed in China on Oct. 23, 2013, under 35 U.S.C. § 119, the entire contents of which are hereby incorporated by reference.

FIELD OF TECHNOLOGY

The present invention relates to the field of construction technology, in particular the apparatus and method for lifting and sliding a structure attached to the wall vertically.

BACKGROUND OF THE INVENTION

With the development of society, the requirement on aesthetic, artistry and comfortability of the construction is higher and higher. Vertical steel grid structures are widely used in shaping and decorating the external walls of high buildings and super-high buildings, as it is aesthetic, light, and can be arranged in a flexible way. However, since urban land is generally scarce, the area for construction is small, and temporary facilities for construction are arranged densely, it is impossible for installing such large vertical structures by integrally lifting construction methods. Therefore, external walls of high buildings and super-high buildings are usually assembled in bulk in high altitude, but such way has disadvantages as follows:

(1) Assembly on site and large volume of welding;

(2) Large quantity of high-altitude work and high safety hazard;

(3) Poor operational environment condition for working on site, which makes it hard to guarantee construction quality, with low efficiency and long construction period.

Construction methods for moving integral structures have been disclosed, for example, Chinese patent application CN 201310196541.1 disclosed a construction apparatus and method for lifting structure integrally over the obstacles in vertical direction to a position with different horizontal projection, and Chinese patent application CN 201310194901.4 also disclosed a construction apparatus and method for lifting and sliding object over barrier in horizontal direction, wherein the structure is lifted and slid by using the hydraulic lifter and the hydraulic push instrument kit, so that the integral structure can be moved and installed in vertical direction or in horizontal direction. However, in the above Chinese patent applications, the lifting or moving of the integral structure is within the area of the building. The structure to be lifted is below the lifter, and the push instrument kit for moving the lifter and the structure horizontally is worked by the base of the push instrument kits forcing against the supporters, e.g. baffles or bolt holes, arranged along the slide rails regularly. When the push instrument kit is working and moving horizontally, the supporting points against the base will be moving forward accordingly, and thus the base of the push instrument kit must be connected and disconnected in turn to the supporters along the slide rails, which is time-wasting, energy-consuming and of safe risks. Further such apparatus and method will be difficult to work if the structure to be lifted locates outside the building, for example, the structures attached to the external wall, such as glass curtain walls and steel work frames. In this circumstance, the lifting platform is a great cantilever, and the hydraulic lifter and the hydraulic push instrument kit locate and move outside the building. In case the apparatus and method disclosed by Chinese patent applications CN201310196541.1 and CN201310194901.4 are used, the operator has to operate the push instrument kit on the great cantilever, that is, the operator must be outside the building and proceed with the connection or disconnection between the base of the push instrument kit and the supporters (such as baffles or bolt holes) periodically along the rail or pathway of the push instrument kit, so that the safety is hard to be ensured.

SUMMARY OF THE INVENTION

With regard to the solution for the above defects, the present invention provides an apparatus and method for lifting and sliding a structure attached to the wall.

With regard to the solution for the above defects, the present invention provides the following:

According to the present invention, the apparatus for lifting and sliding a structure attached to the wall comprises a lifting platform which is arranged on the roof and extends out over the building, and a synchronous lifting and sliding system which is arranged on the lifting platform. The lifting platform comprises two platform beams extending out over the building, and the lifting beam is placed on the platform beam;

The synchronous lifting and sliding system comprises a hydraulic lifter arranged on the lifting beam, a hydraulic push instrument kit arranged on the platform beam, and a controller for controlling the hydraulic lifter and the hydraulic push instrument kit;

The lifting beam is equipped with a connecting ear-plate to connect with the hydraulic push instrument kit, and the lifting beam is connected with the body of the hydraulic push instrument kit through the connecting ear-plate. A connecting rod is connected to the head of the hydraulic push instrument kit;

An installing ear-plate is arranged on the platform beam within the building, to connect with the connecting rod, wherein several installing holes are arranged at regular intervals on the connecting rod, one end of connecting rod is connected with the head of the hydraulic push instrument kit, while the other end of the connecting rod is connected with the installing ear-plate, and the distance between the adjacent installing holes on the connecting rod matches with a stroke of the hydraulic push instrument kit;

The hydraulic lifter is connected with the structure to be installed by a lifting steel strand, and the end of the steel strand is equipped with lifting hangers which can open and close flexibly.

Further, a slider is provided on the bottom of the lifting beam, and the contacting surface between the platform beam and the slider is smooth, such that smooth sliding can be achieved.

Further, for the convenience of installing and uninstalling the structure, the lifting hangers comprises an upper member which connects with the lifting steel strand, and a lower member which connects with the structure to be installed, wherein the upper member and the lower member are connected via a first hinge pin, and thus the lower member can be rotated relative to the upper member flexibly, so that the hanger can facilitate the locating, installing and uninstalling of the structure.

Further, the lower member comprises an inverted U-shape body and a locking rod which is placed at the opening of the inverted U-shape body, wherein pin holes for installing the locking rod are arranged at both ends of the opening of the inverted U-shape body, so that the locking rod connects with the inverted U-shape body via a second hinge pin, and the second hinge pin at the both ends of the locking rod can be uninstalled easily.

Further, in order to improve the efficiency of the hydraulic push instrument kit, the installing hole of the installing ear-plate, and the connecting hole of the connecting ear-plate in the lifting beam lie on a same horizontal axis.

A method for lifting and sliding a structure attached to the wall disclosed by the present invention, comprising the steps of:

(1) assembling a lifting platform extending out over the building on the roof, wherein the lifting platform comprises two platform beams extending out over the building, and a lifting beam is arranged on the platform beams, wherein a slider is provided on the bottom of the lifting beam;

(2) providing a hydraulic lifter on the lifting beam, and installing a hydraulic push instrument kit and a connecting rod on each platform beam;

(3) dividing the structure into a number of installing units according to the shape of the structure, environment and location conditions and the lifting ability of the lifter, and placing the installing units in the proper position below the lifting platform.

(4) welding location-limited blocks on two sides of the lifting point on the steel beam of one of the number of installing units to prevent the lifting hanger from sliding, and connecting the lifting hanger to the installing unit. When installation, the second hinge pin at one end of the locking rod of the lifting hanger is released, the locking rod rotates around the second hinge pin on the other end, and the locking rod will be opened to allow the steel beam of the installing unit to enter the inverted U-shape body of the lifting hanger, and then the end with the second hinge pin released of the locking rod is closed and locked by the second hinge pin, whereby the connection between the lifting hanger and the installing unit is accomplished;

(5) lifting the installing unit in step (4) to a designed elevation position using the hydraulic lifter;

(6) moving the lifting beam and the installing unit in step (5) inward to a designed installing position through the hydraulic push instrument kit. Several installing holes are arranged at regular intervals on a connecting rod, one end of the connecting rod is connected with a head of the hydraulic push instrument kit, while the other end of the connecting rod is connected with a installing ear-plate arranged on the platform beam, and distance between the installing holes on the connecting rod matches with stroke of the hydraulic push instrument kit. When the hydraulic push instrument kit is working, the head of the hydraulic push instrument kit is retracted, driving the lifting beam and the installing unit to slide towards the target position by means of the action of the connecting rod, until the hydraulic instrument kit completes a stroke. Then the hinge pin between the connecting rod and the installing ear-plate is released, the head of the hydraulic instrument kit extends out, pushing the connecting rod slide inward horizontally for a stroke, and the connecting rod moves inward a distance corresponding to the stroke, then the connecting rod is locked again with the installing ear-plate via a hinge pin, and the hydraulic push instrument kit begins next stroke; Repeating the above steps until the installing unit slides horizontally to the designed installing position.

(7) unloading the hydraulic lifter after the installing unit in step (6) has been installed, until the whole load is transferred to the installing unit to be lifted, and then dismantling the lifting hanger by releasing the second hinge pin on one end of the locking rod, leading the locking rod rotating around the second hinge pin at the other end of the locking rod and opening the inverted U-shape body of the lifting hanger;

(8) moving the lifting beam and the hydraulic lifter outward to position of next one of the number of installing units, being ready for lifting the next installing unit by means of operating the step (6) conversely. The connection between the connecting rod and the installing ear-plate is released, the head of the hydraulic push instrument kit is retracted, driving the connecting rod to move outward a stroke horizontally, then the connecting rod and the installing ear-plate are connected via a hinge pin, and then the head of the hydraulic push instrument kit extends out, pushing the lifting beam to move outward for a stroke horizontally. Repeating the above actions until the lifting beam and the hydraulic lifter are moved horizontally to the position of the next installing unit.

(9) repeating steps (3) to (8) to install each installing unit attached to the wall of building from the bottom up of the building until the whole structure is installed completely to attach the wall.

Comparing with the prior art, a connecting rod is provided on the push instrument kit according to the present invention in a creative way, wherein a plurality of installing holes are arranged at regular intervals along the length of the connecting rod.

The connecting rod is used as the transition connector between the push instrument kit and the supporter, e.g. installing ear-plate arranged on the platform, as well as the guiding rails for the push instrument kit to move forward or backward. The connecting rod is always supported on the fixed point of the platform beam on the inner side of the building when the push instrument kit moves forward or backward. While the push instrument kit moves, the connecting rod and the supporting point will be connected and disconnected periodically, and thus the operator only needs to work at a fixed point within the range of the building with less time and energy but more safety.

The present invention can achieve the following advantages:

1. most of the construction work are done on the ground, with little influence on the other construction, and the construction can be carried out in parallel, which is good for the total control of the object;

2. by using the principle of limit unit, the structure attached to the wall can be divided into a number of installing units, and then these units are assembled in the factory or on the ground, so as to lift and slide the whole structure during construction with less installing workload at altitudes, higher construction efficiency and shorter construction period;

3. the division of the units is optimized and improved, so that small hydraulic lifting and sliding device can be selected but strong mobility, and it is convenient to transport and install the units, especially to lift larger structure in narrow space;

4. taking the integral structure apart into a number of units to be lifted and installed will be more convenient to transport, and the size of the unit can be determined according to the ground conditions, the quantity of the hydraulic lifting system can be arranged according to the unit configuration, so that the construction is done according to circumstances flexibly;

5. the connection between the lifter and the structure can be achieved by the lifting hangers and the steel beam on the structure, and the upper member of the hanger is connected with the lower member of the hanger via a hinge. This makes the connection or disconnection between the lifter and the structure convenient, with simple operation and high efficiency at altitude.

BRIEF DESCRIPTION OF THE DRAWINGS

The present invention will be further described in details hereinafter with the reference to accompanying drawings and exemplary embodiment, in which.

LIST OF REFERENCE CHARACTERS

Figure 1:
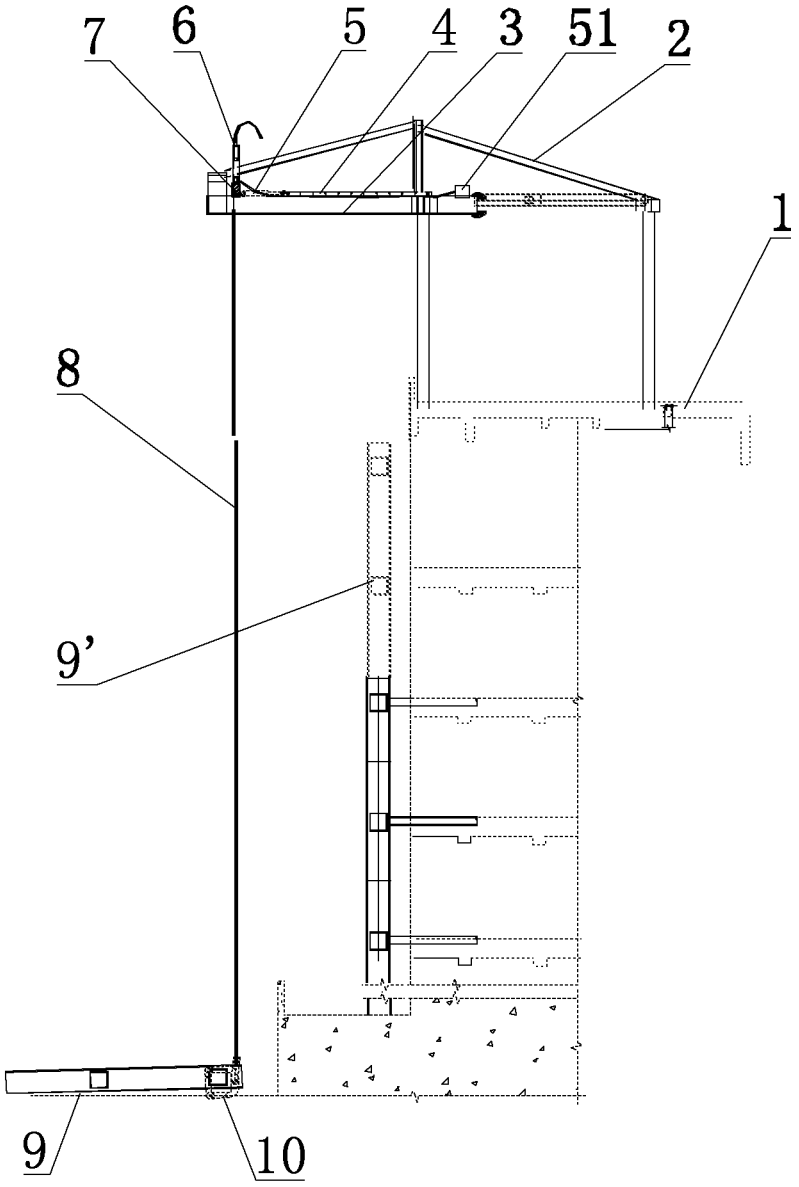
FIG. 1 is a schematic view of installation according to the present invention.
Figure 2:
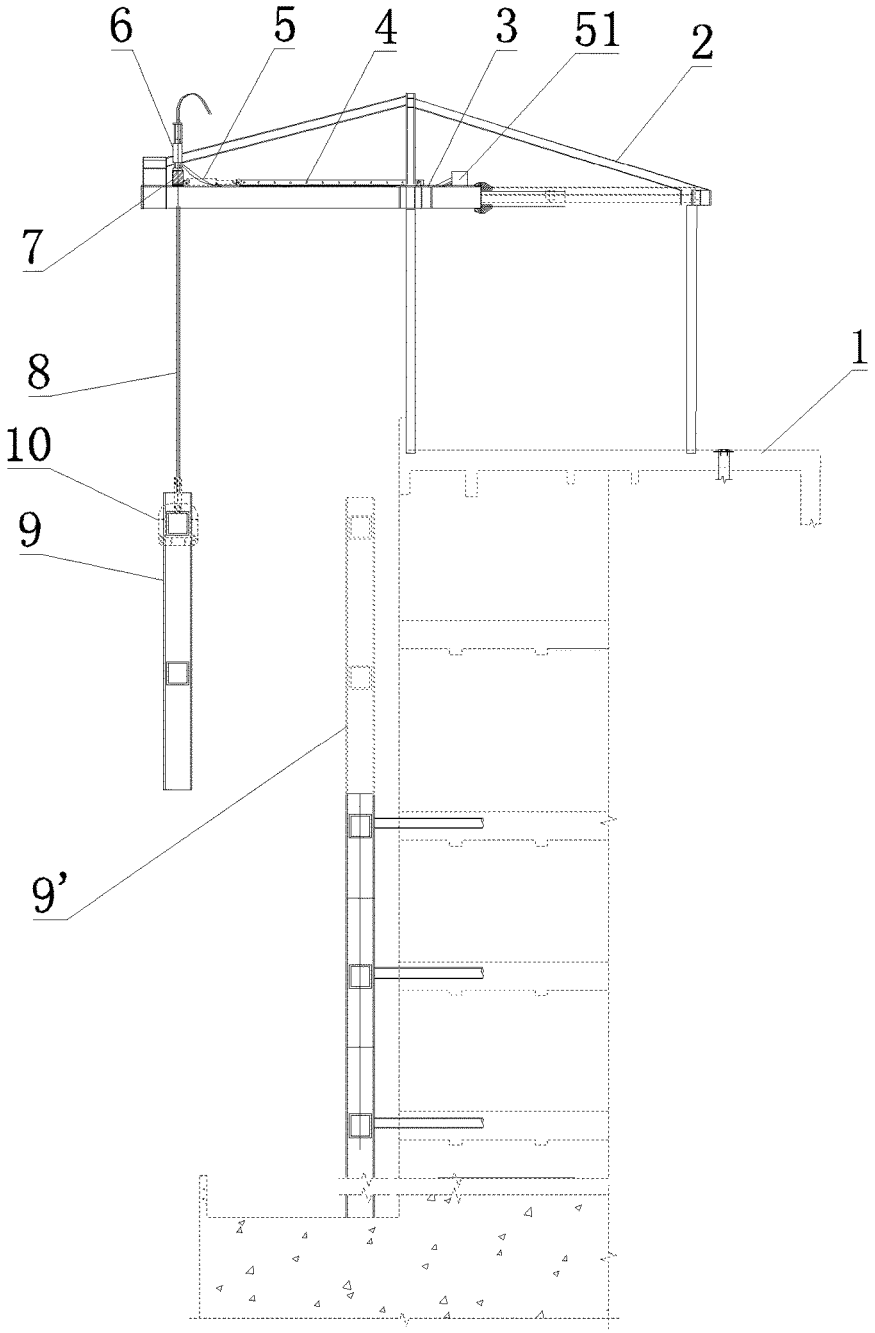
FIG. 2 is a schematic view of lifting according to the present invention.
Figure 3:
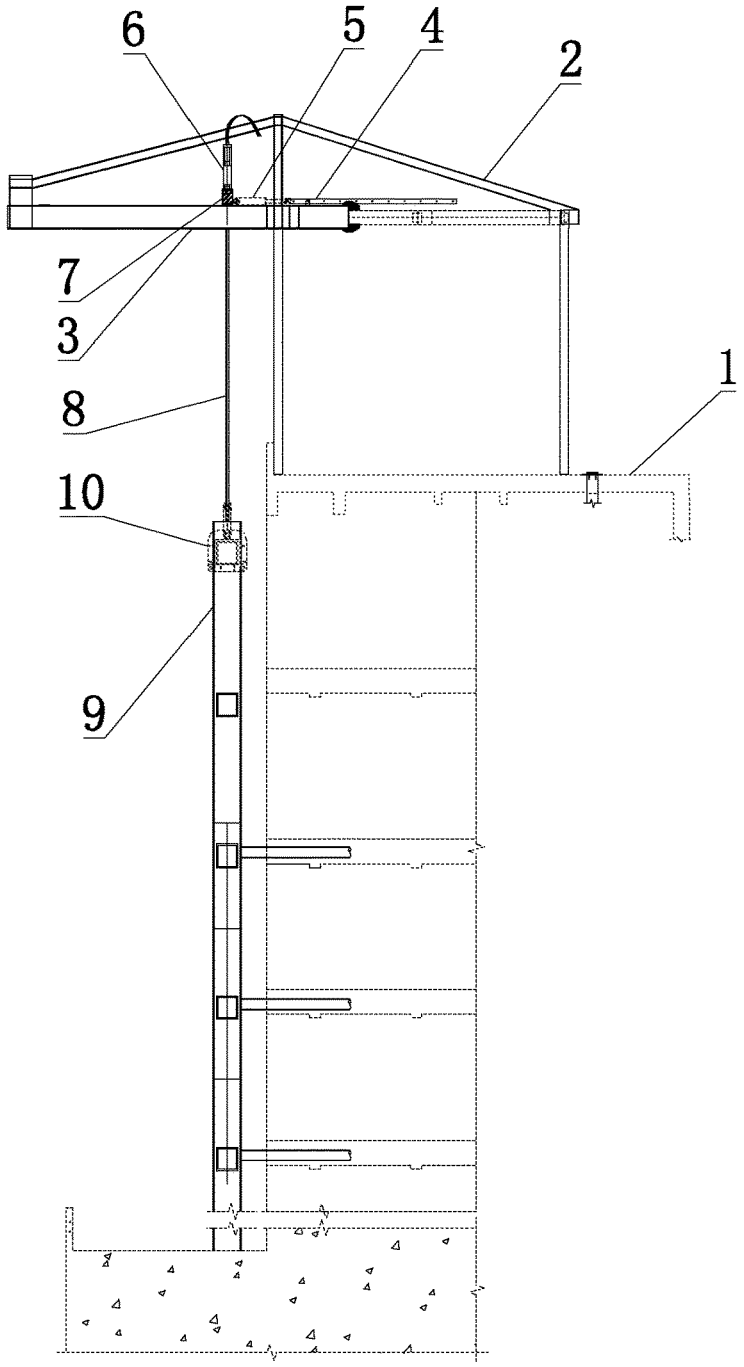
FIG. 3 is a schematic view of sliding according to the present invention.
Figure 4:
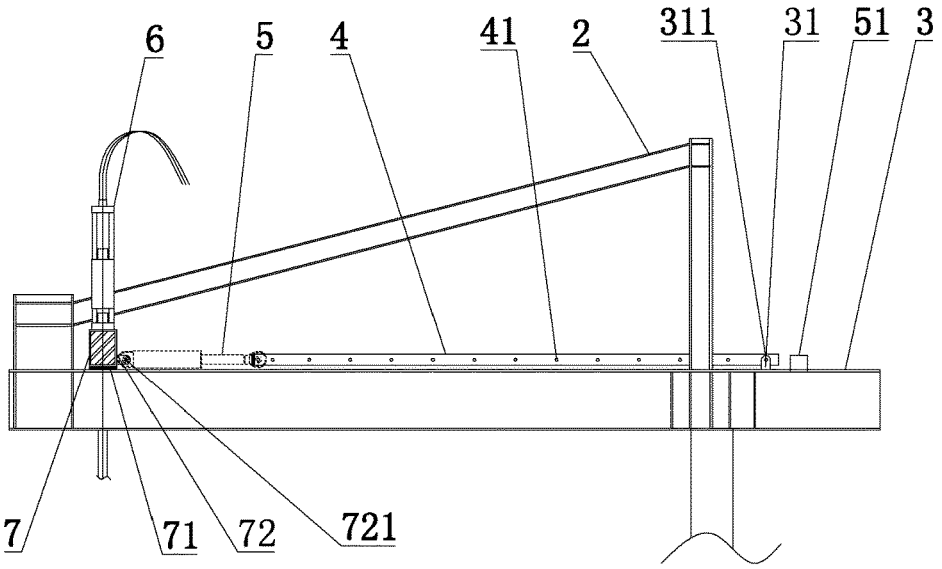
FIG. 4 is a schematic view of the synchronous lifting and sliding system according to the present invention.
Figure 5:
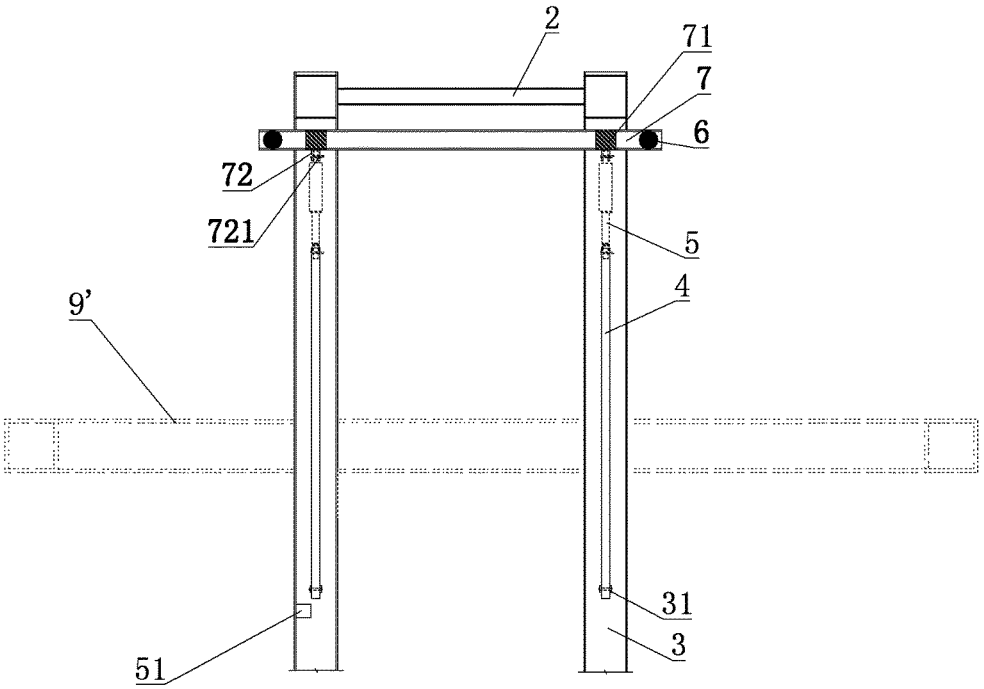
FIG. 5 is a schematic view of the layout of the synchronous lifting and sliding system according to the present invention.

1 roof
2 frame
3 platform beam
31 installing ear-plate
311 installing hole
4 connecting rod
41 installing hole of the connecting rod
5 hydraulic push instrument kit
51 controller
6 hydraulic lifter
7 lifting beam
71 slider
72 connecting ear-plate
721 connecting hole
8 steel strand
9 installing unit
91 location-limited block
9' installing position
10 lifting hangers
110 upper member of the lifting hanger
111 installing plate
112 connecting baffle
113 steel strand hole
114 connecting hole of the upper member
115 stiffening plate
101 first hinge pin
210 lower member of the lifting hanger
211 inverted U-shape body
212 connecting plate
213 connecting hole of the lower member
214 pin hole
102 second hinge pin
221 locking rod
222 connecting hole of the locking rod

DETAILED EMBODIMENTS

Preferred embodiments of the present invention would be described with reference to the drawings as follows. It should be understood that the preferred embodiments described here are only used for description and explanation, but not for limiting the present invention.

As shown in FIG. 1 to FIG. 5, the apparatus for lifting and sliding the structure attached to the wall according to the present invention comprises a lifting platform, and an apparatus for lifting and sliding which are arranged on the roof 1, wherein the lifting platform comprises a frame 2 and two platform beams 3 extending out over the building. A lifting beam 7 is placed on the platform beams 3.

The apparatus for lifting and sliding comprises a hydraulic lifter 6 fixed on the lifting beam 7, a hydraulic push instrument kit 5 arranged on the platform beam 3, and a controller 51 for controlling the hydraulic lifter 6 and the hydraulic push instrument kit 5.

The hydraulic push instrument kit 5 comprises a body and a head.

The lifting beam 7 is equipped with a connecting ear-plate 72 connected with the body of the hydraulic push instrument kit 5, and a connecting rod 4 is connected to the head of the hydraulic push instrument kit 5. An installing ear-plate 31 is arranged on the platform beam 3 to connect with the connecting rod 4, wherein the connecting hole 721 of the connecting ear-plate 72 and the installing hole 311 of the installing ear-plate 31 lie on a same horizontal axis.

A plurality of installing holes 41 are arranged at regular intervals along the connecting rod 4, wherein the distance between the adjacent installing holes 41 matches with a stroke of the hydraulic push instrument kit 5.

Further, a slider 71 is provided between the bottom of the lifting beam 7 and the platform beam 3, wherein there is a smooth surface between the platform beam 3 and the slider 71.

The hydraulic push instrument kit 6 is provided with a lifting steel strand 8 connected with the installing unit 9 to be installed, wherein the end of the steel strand 8 is equipped with a lifting hanger which can open and close flexibly.

Figure 6:
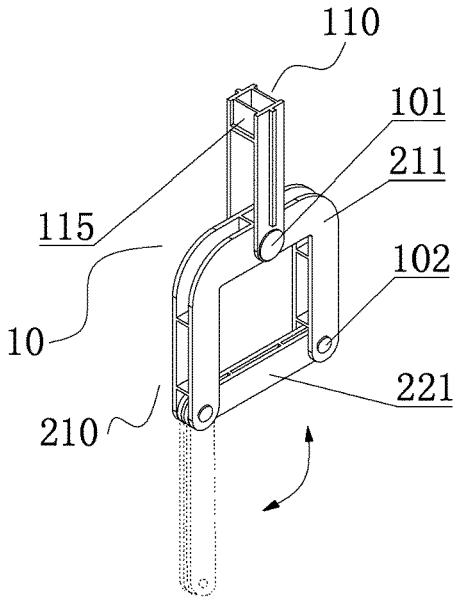
FIG. 6 is a schematic view of the installing unit of the lifting hanger according to the present invention.
Figure 7:
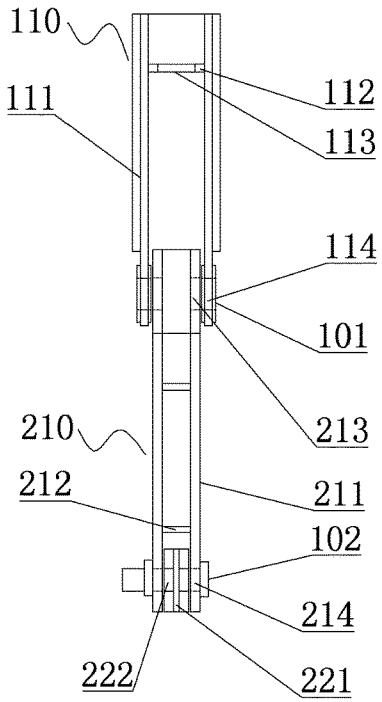
FIG. 7 is a side view of the lifting hanger according to the present invention.
Figure 8:
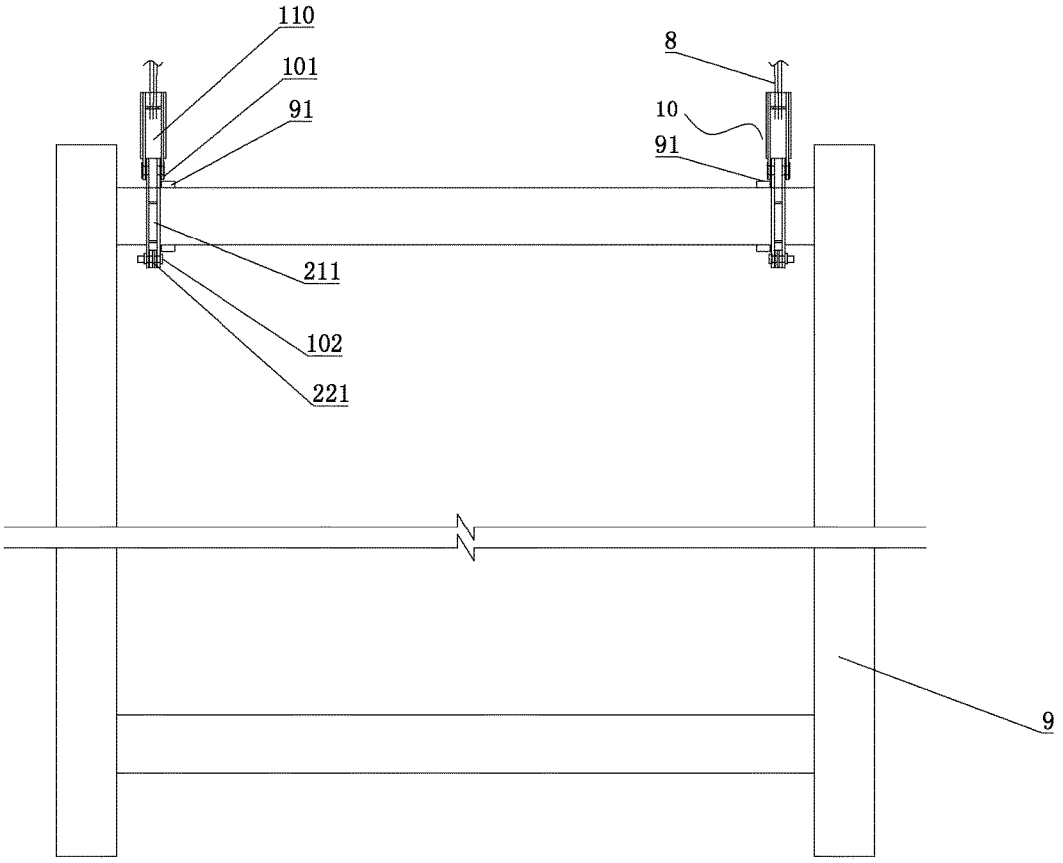
FIG. 8 is a schematic view of installing the lifting hanger according to the present invention.

As shown in FIGS. 6 to 8, the lifting hangers 10 comprise an upper member 110 which connects with the lifting steel strand 8, and a lower member 210 which connects with the installing unit 9 to be installed, wherein the upper member 110 and the lower member 210 are connected via a first hinge pin 101, and thus the upper member 110 can be rotated relative to the first hinge pin 101, so that the steel strand 8 is not easy to bend during lifting.

The upper member 110 comprises two installing plates 111 arranged in parallel one another, and a connecting baffle 112 for connecting the two installing plates 111, wherein the connecting baffle 112 has a steel strand hole 113 for receiving the steel strand 8, and connecting holes 114 of the upper member are equipped with the lower part of the installing plates 111 to connect with lower member 210 via hinge. A stiffening plate 115 is provided on the connecting baffle 112.

The lower member 210 comprises an inverted U-shape body 211 and a locking rod 221 which is placed at the opening of the inverted U-shape body 211, wherein the inverted U-shape body 211 comprises two parallel U-shape steel plates which are connected by a connecting plate 212.

Connecting holes 213 of the lower member are provided in the top center of the inverted U-shape body 211 to be used for connecting with the upper member 110. The inverted U-shape body 211 has pin holes 214 located at two ends thereof, to be used for connecting with the locking rod 221. Connecting holes 222 are provided at two ends of the locking rod 221, so that the locking rod 221 can connects with the inverted U-shape body 211 via second hinge pins 102 at both ends. The first hinge pin 101 and the second hinge pins 102 can consist of a screw bolt and a nut, or a hinge pin or a cotter pin with through-holes at both ends, or a hinge pin with threaded holes on both end and a screw.

When use, the second hinge pin 102 at one end of the locking rod 221 is released, and the locking rod 221 rotates around the hinge pin at the other end, and then the locking rod 221 is in open condition, so that the lower member 210 forms an opening for receiving the steel beam of the installing unit 9.

A location-limited block 91 is provided on the steel beam on the installing unit 9 which is connected with the lifting hanger 10, in order to prevent the lifting hanger 10 from sliding.

A method for lifting and sliding the structure attached to the wall according to the present invention, comprising the steps of:

(1) assembling a lifting platform extending out over the building on the roof, wherein the lifting platform comprises a frame 2 and two platform beams 3; setting a lifting beam 7 on the platform beams 3, and a slider 71 is provided on the bottom of the lifting beam 7.

(2) providing two sets of hydraulic lifters 6 at both ends of the lifting beam 7, and installing a hydraulic push instrument kit 5 and a connecting rod 4 on each platform beam 3.

(3) providing a lifting hanger 10 at the end of the steel strand 8 of the hydraulic lifter 6.

(4) dividing the structure into a number of installing units according to the features of the structure, environment and location conditions and the lifting ability of the lifter 6, and arranging the installed unit in the proper position below the lifting platform.

(5) setting up two lifting points on the steel beams of the installed unit, welding location-limited blocks 91 on two sides of the lifting point on each steel beam of the installed unit to prevent the lifting hanger from sliding, and connecting the lifting hangers 10 and the installed unit. When installing, the second hinge pin 102 on one end of the locking rod 221 of the lifting hanger 10 is released, the locking rod 221 rotates around the second hinge pin 102 on the other end, and the locking rod 222 will open to allow the steel beam of the installed unit 9 to enter the inverted U-shape body 211 of the lifting hanger, and then the released end of the locking rod 221 is closed and locked by the second hinge pin 102, whereby the connection between the lifting hanger 10 and the installed unit 9 is accomplished.

(6) lifting the installed unit 9 by the synchronizing lifting and sliding system gradually, i.e. lifting the installed unit 9 in turn in the designed lifting power of the hydraulic lifter of 20%、40%、60%、70%、80%、90%、95%、100%, until the installed unit 9 parts from the ground completely and is lifted to 100 mm to 1000 mm high, preferably stay a while at 150 mm, 200 mm high.

(7) Keeping the installed unit at a certain height for 4 to 12 hours, preferably 6 hours, or 8 hours, and detecting whether the transformation of the lifting platform exceeds the allowable value, or whether the lifting hangers 10 have any looseness or transformation. If not, keep lifting the installed unit 9, and measure the heights of two lifting hangers 10 by means of the laser range finder for each 4-6 cm rise, then compare their height. If the heights difference is bigger than the preset value, the difference can be adjusted manually, so that the two hydraulic lifters 6 can lift the installed unit 9 synchronically, eventually the installed unit 9 can be lifted to the designed elevation position.

(8) moving the lifting beam 7 and the installed unit inward to the designed installing position through the hydraulic push instrument kit 5; Several installing holes 41 are arranged at regular intervals on the connecting rod 4, one end of connecting rod 4 is connected with the head of the hydraulic push instrument kit 5, while the other end of the connecting rod 4 is connected with the installing ear-plate 31 arranged on the platform beam via the hinge pin, and the distance between the installing holes 41 on the connecting rod matches with the stroke of the hydraulic push instrument kit 5. When the hydraulic push instrument kit 5 is working, the head of the hydraulic push instrument kit 5 is retracted, driving the lifting beam 7 to slide towards the target position by means of the action of the connecting rod 4, until the hydraulic instrument kit 5 completes a stroke. Then the hinge pin between the connecting rod 4 and the installing ear-plate 31 is released, and the head of the hydraulic instrument kit 5 extends out, pushing the connecting rod 4 slide inward horizontally for a stroke, and the connecting rod 4 moves inward a distance corresponding to the stroke, then the connecting rod is locked again with the installing ear-plate 31 via a hinge pin, and the hydraulic push instrument kit 5 begins next stroke; Repeating the above steps until the installed unit 9 slides horizontally to the installing position 9'.

(9) unloading the hydraulic lifter 6 step by step after the installed unit 9 has been installed, until the whole load is transferred to the installed unit, and then dismantling the lifting hangers 10 by releasing the second hinge pin 102 on one end of the locking rod 221, leading the locking rod 221 rotating around the second hinge pin 102 at the other end of the locking rod 221 and opening the inverted U-shape body of the lifting hanger

(10) moving the lifting beam 7 and the hydraulic lifter 5 outward to the initial lifting position of next installing unit, being ready for lifting the next installing unit by means of operating the step (8) conversely. The connection between the connecting rod 4 and the installing ear-plate 31 is released, the head of the hydraulic push instrument kit 5 is retracted, driving the connecting rod 4 to move outward a stroke horizontally, then the connecting rod 4 and the installing ear-plate 31 are connected via a hinge pin, and then the head of the hydraulic push instrument kit 5 extends out, pushing the lifting beam 7 to move outward for a stroke horizontally. Repeating the above steps until the lifting beam 7 and the hydraulic lifter 6 move horizontally to the initial lifting position of the installing unit.

(11) repeating steps (4) to (10), and installing each installing unit from the bottom of the building until the highest installed unit is installed, and the whole structure will be installed to attach the wall completely.

The synchronous hydraulic lifting and sliding system according to the present invention, can lift the integral structure attached to the wall, leading a plenty of the work operating on the ground, whereby the work efficiency can be improved and the quality of construction is ensured. By using the lifting hangers to connect with the steel beams of the installed unit, the installed unit can be connected or disconnected with the steel strand conveniently. The upper member and the lower member are connected via hinge, facilitating the operation of lifting the installed unit.

The embodiment described hereinbefore is merely preferred embodiment of the present invention and not for purposes of any restrictions or limitations on the invention. It will be apparent that any non-substantive, obvious alterations or improvement by the technician of this technical field according to the present invention may be incorporated into ambit of claims of the present invention.

What is claimed is:

1. A construction method, comprising the steps of:

(1) assembling a lifting platform which is arranged on a roof of a building and extends outwardly from the building, wherein the lifting platform comprises two platform beams extending outwardly from the building, and a lifting beam is arranged on the platform beams, wherein a slider is provided on the bottom of the lifting beam;

(2) providing a hydraulic lifter on the lifting beam, and installing a hydraulic jack and a connecting rod on each of the two platform beams;

(3) dividing a structure to be lifted into a number of installing units, and placing the number of the installing units in a proper position below the lifting platform;

(4) welding location-limited blocks on two sides of a lifting point on a steel beam of one of the number of the installing units to prevent a lifting hanger from sliding, and connecting the lifting hanger to the one of the number of the installing units and, when installing, a second hinge pin at one end of a locking rod of the lifting hanger is released, the locking rod rotates around the second hinge pin on the other end, and the locking rod is opened to allow the steel beam of the one of the number of the installing units to enter an inverted U-shape body of the lifting hanger, and then the end with the released second hinge pin of the locking rod is closed and locked by the second hinge pin, whereby the connection between the lifting hanger and the one of the number of the installing units is accomplished;

(5) lifting the one of the number of the installing units in step (4) to a desired elevation position using the hydraulic lifter;

(6) moving the lifting beam and the one of the number of the installing units in step (5) inward to a desired installing position through the hydraulic jack; several installing holes are arranged at regular intervals on a connecting rod, one end of the connecting rod is connected with a head of the hydraulic jack, while the other end of the connecting rod is connected with an installing ear-plate arranged on the platform beam, and a distance between the installing holes on the connecting rod matches with a stroke of the hydraulic jack; when the hydraulic jack is working, the head of the hydraulic jack is retracted, driving the lifting beam and the one of the number of the installing units to slide towards a target position by means of the action of the connecting rod, until the hydraulic jack completes a stroke, then the hinge pin between the connecting rod and the installing ear-plate is released, the head of the hydraulic jack extends out, pushing the connecting rod to slide inward horizontally for a stroke, and the connecting rod moves inward a distance corresponding to the stroke, then the connecting rod is locked again with the installing ear-plate via a hinge pin, and the hydraulic jack begins next stroke; repeating the above steps until the one of the number of the installing units slides horizontally to the installing position;

(7) unloading the hydraulic lifter after the one of the number of the installing units in step (6) has been installed, until the whole load is transferred to the one of the number of the installing units, and then dismantling the lifting hanger by releasing the second hinge pin on one end of the locking rod, leading the locking rod rotating around a second hinge pin at the other end of the locking rod and opening the inverted U-shape body of the lifting hanger;

(8) moving the lifting beam and the hydraulic lifter outward back to a position of a next one of the number of the installing units, being ready for lifting the next one of the number of the installing units by means of operating the step (6) conversely; the connection between the connecting rod and the installing ear-plate is released, the head of the hydraulic jack is retracted, driving the connecting rod to move outward a stroke horizontally, then the connecting rod and the installing ear-plate are connected via a hinge pin, and then the head of the hydraulic jack extends out, pushing the lifting beam to move outward for a stroke horizontally; repeating the above actions until the lifting beam and the hydraulic lifter are moved horizontally to the position of the next one of the number of the installing units;

(9) repeating steps (3) to (8) to install each of the number of the installing units from a bottom to a top of the building until the structure is installed completely to attach a wall of the building.

* * * * *